US007191124B2

(12) United States Patent
Kaminuma

(10) Patent No.: US 7,191,124 B2
(45) Date of Patent: Mar. 13, 2007

(54) VOICE INPUT AND OUTPUT APPARATUS WITH BALANCING AMONG SOUND PRESSURES AT CONTROL POINTS IN A SOUND FIELD

(75) Inventor: Atsunobu Kaminuma, Yokohama (JP)

(73) Assignee: Nissan Motor Co., Ltd., Kanagawa-Ken (JP)

( * ) Notice: Subject to any disclaimer, the term of this patent is extended or adjusted under 35 U.S.C. 154(b) by 919 days.

(21) Appl. No.: 10/253,882

(22) Filed: Sep. 25, 2002

(65) Prior Publication Data

US 2003/0065513 A1 Apr. 3, 2003

(30) Foreign Application Priority Data

Sep. 27, 2001 (JP) ..... 2001-296641
Jan. 17, 2002 (JP) ..... 2002-008909

(51) Int. Cl.
*G10L 19/14* (2006.01)

(52) U.S. Cl. ..... 704/225; 704/233

(58) Field of Classification Search ..... 704/225, 704/233, 260; 379/88.01; 381/1
See application file for complete search history.

(56) References Cited

U.S. PATENT DOCUMENTS 5,548,346 A * 8/1996 Mimura et al. ..... 348/738
5,572,591 A * 11/1996 Numazu et al. ..... 381/1
5,809,150 A * 9/1998 Eberbach ..... 381/300
5,991,385 A * 11/1999 Dunn et al. ..... 379/202.01

FOREIGN PATENT DOCUMENTS

| | | |
|---|---|---|
| JP | 6-075585 | 3/1994 |
| JP | 7-240722 | 9/1995 |
| JP | 8-205299 | 8/1996 |
| JP | 9-130306 | 5/1997 |
| JP | 10-066189 | 3/1998 |
| JP | P2000-316049 A | 11/2000 |
| JP | 2001-119470 | 4/2001 |

OTHER PUBLICATIONS

"Prospects for Transaural Recording", J. Audio Eng. Soc., vol. 37, No. 1/2, pp. 3-19 (1989).
"An inverse filter design for transaural-system using least-norm-solution" wrtten by A. Kaminuma, S. Ise and K. Sikano, Symposium of The Acoustical Society of Japan, 1-9-13, 1009-09, pp. 495-496.

* cited by examiner

*Primary Examiner*—Michael N. Opsasnick
(74) *Attorney, Agent, or Firm*—McDermott Will & Emery LLP

(57) ABSTRACT

A voice input and output apparatus is comprised of a voice output section that produces a sound field by outputting a sound on the basis of a voice output signal. A voice signal control section derives a calculation expression of a filtering process on the basis of a space transfer characteristics between the voice output section and control points. The voice signal control section produces the voice output signal by executing the filtering process of a voice input signal, so that a balance among sound pressures at predetermined control points in the sound field takes a predetermined balance.

11 Claims, 6 Drawing Sheets

VOICE INPUT AND OUTPUT APPARATUS WITH BALANCING AMONG SOUND PRESSURES AT CONTROL POINTS IN A SOUND FIELD

BACKGROUND OF THE INVENTION

The present invention relates to a voice input and output apparatus, and more particularly to a voice input and output apparatus which improves a S/N ratio of input voice and decreases an influence of returning sound.

Japanese Patent Provisional Publication No. 2000-316049 discloses a voice input and output apparatus of a hand-free type. Generally, it is important for a voice input and output apparatus to ensure the accuracy of input voice, that is, to keep a S/N ratio of a talker's voice at a predetermined level. Therefore, this hand-free type voice input and output apparatus is arranged such that a loudspeaker functioning as a sound source and a microphone functioning as a sound input device are adjacently disposed. This arrangement enables a talker to speak toward the loudspeaker so as to improve a sound picking-up ability of the apparatus.

SUMMARY OF THE INVENTION

However, in case that a microphone and a loudspeaker are adjacently disposed, there is a tendency that a voice outputted from the loudspeaker is received by the microphone, that is, so-called acoustic feedback is generated. Such acoustic feedback will degrade a S/N ratio of a voice to be received by the voice input device.

It is therefore an object of the present invention to provide a voice input and output apparatus which improves a S/N ratio of input voice and decreases an influence of wrap-around sound by controlling a voice output signal at each control point in a sound field of the outputted voice.

An aspect of the present invention resides in a voice input and output apparatus which comprises a voice output section and a voice signal control section. The voice output section produces a sound field by outputting a sound on the basis of a voice output signal. The voice signal control section generates the voice output signal according to a voice input signal so that a balance among sound pressures at a plurality of control points in the sound field takes a predetermined balance.

Another aspect of the present invention resides in a method of outputting a sound with directionality. The method comprises a step of receiving a voice input signal, a step of generating a voice output signal according to the voice input signal so that a balance among sound pressures at a plurality of control points in a sound field takes a predetermined balance, and a step of producing the sound field by outputting the sound on the basis of the voice output signal.

A further another aspect of the present invention resides in a voice input and output apparatus provided in a passenger compartment of a vehicle. The voice input and output apparatus comprises a voice output section which produces a sound field by outputting a sound on the basis of a voice output signal; a condition detecting section which detects a circumstantial condition relating to a characteristic of the sound; a storage section which stores a filtering process table which shows a relationship between a calculation expression of the filtering process of a circumstantial condition relating to a characteristic of the sound; and a voice signal control section which is coupled to the voice output section, the condition detecting section and the storage section. The voice signal control section receives a voice input signal. The voice signal control section is arranged to determine according to a change of the circumstantial condition whether the calculation expression is changed, to determine the calculation expression from the relationship and the circumstantial condition, and to produce the voice output signal by executing the filtering process of the voice input signal using the calculation expression.

The other objects and features of this invention will become understood from the following description with reference to the accompanying drawings.

DETAILED DESCRIPTION OF THE INVENTION

Figure 1:
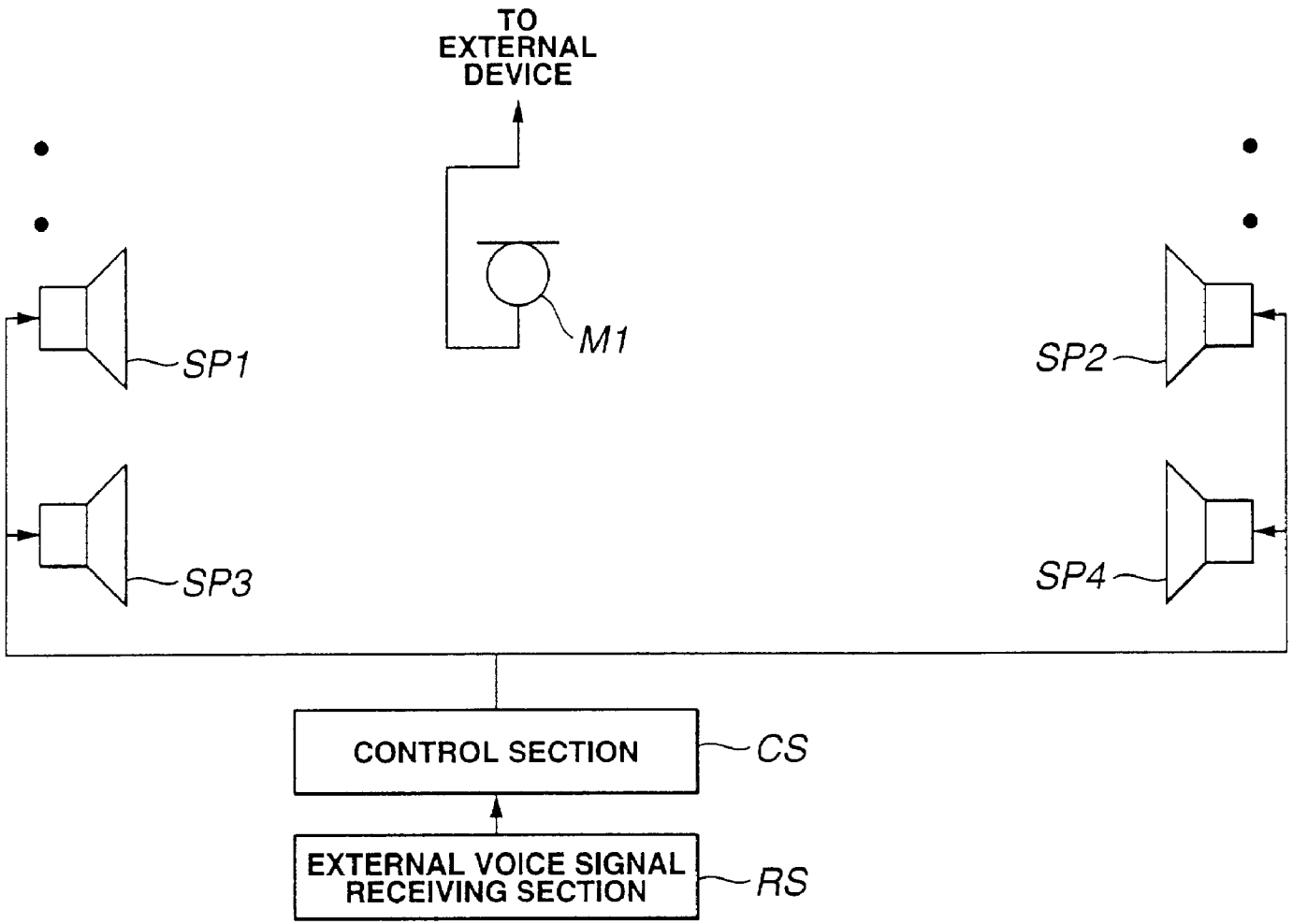
FIG. 1 is a block diagram for schematically explaining a construction of a voice input and output apparatus according to the present invention.
Figure 2:
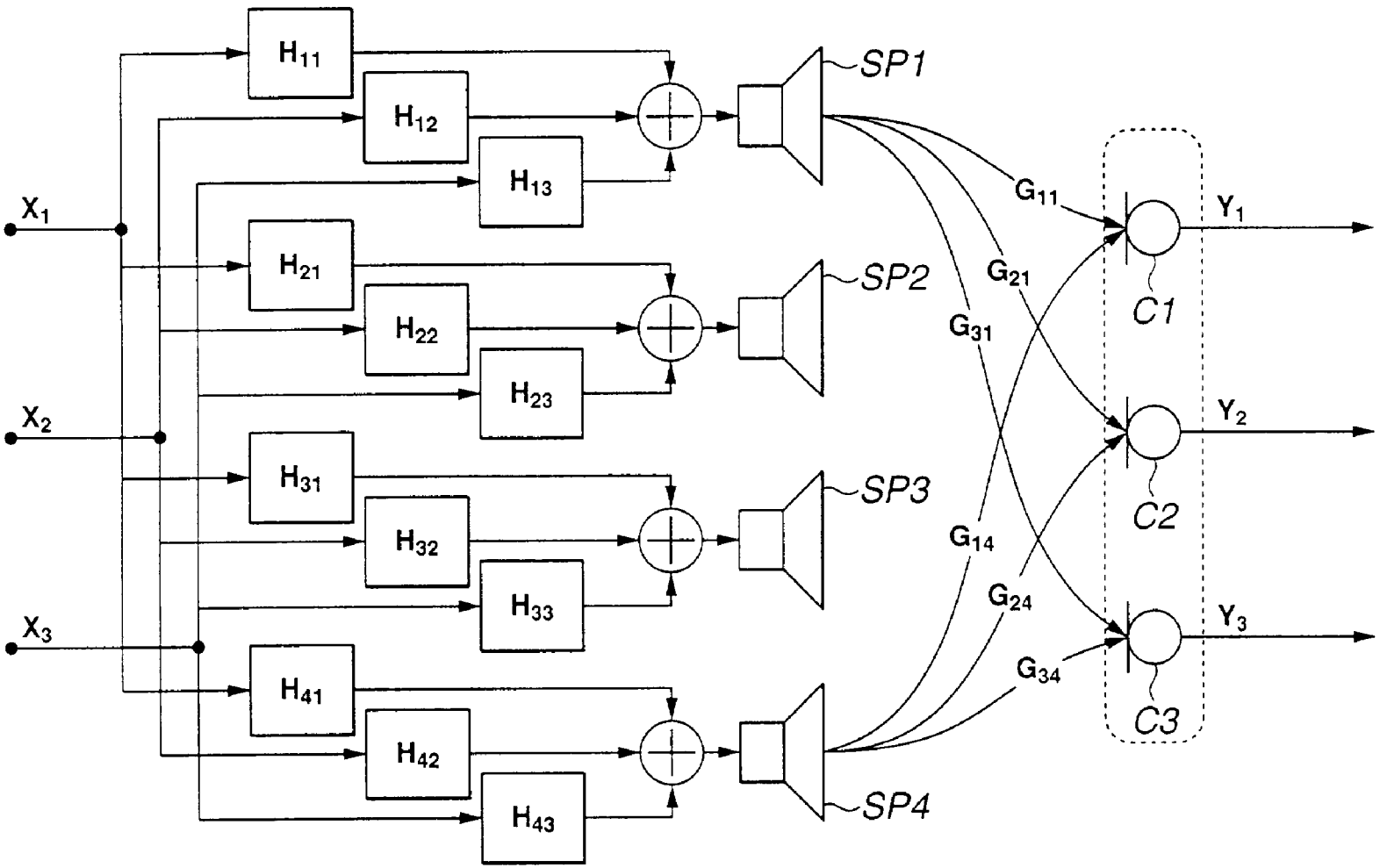
FIG. 2 is an explanatory view for explaining a principle of a sound control according to the present invention.

Referring to FIGS. 1 and 2, a basic concept of the present invention will be discussed first. The present invention is based on a theory of controlling a balance of the sounds including sound pressures at predetermined positions (control points).

FIG. 1 shows an example of a voice input and output apparatus based on the theory. The voice input and output apparatus comprises a voice signal receiving section RS for receiving a voice signal, a control section CS, four voice output sections of loudspeakers SP1, SP2, SP3 and SP4, and a voice input section of a microphone M.

The voice input and output apparatus receives the voice signal through voice signal receiving section from an external telecommunication device, a voice synthesizer and/or a sound signal supplying section such as a computer. The control section SS converts the voice signal into the voice output signals. The voice based on the voice output signals is outputted through loudspeakers SP1, SP2, SP3 and SP4 and is heard by a listener. On the other hand, microphone M receives voices of a talker and outputs the received voices to the telecommunication device and/or computer.

Loudspeakers SP1 through SP4 and microphone M are disposed so as to establish a predetermined positional relationship therebetween. This positional relationship can be limited with reference to predetermined space axes in the sound field. The positions of the predetermined control points in the sound field can be also limited with reference to the space axes.

Subsequently, a control method of the sound will be explained with reference to FIG. 2. Although a transaural method as to the sound control is exemplified herein, it will be understood that the present invention is not limited to this control corresponding to the transaural method, and may employ the other theory which enables the sound pressure control at the respective control points.

The transaural method has been shown in a paper "Prospects for Transaural Recording" which was disclosed in *J. Audio Eng. Soc.,* vol.37, No.1/2, 1989, pp.3–19.

The voice input and output apparatus of the present invention, which is based on the transaural method, controls the balance of the sound at desired control points such as at two positions near the respect ears of a listener. FIG. 2 shows transfer lines employed in a case that the sound pressures at three control points are controlled using four loudspeakers S1 through S4.

Sounds generated by a sound source is transmitted through transfer medium and produces a sound field. Under this sound generated condition, space transfer lines functioning as sound transfer line are produced between the sound source and the preferred points in the sound field.

The energy condition of the sound on the space transfer line can be represented by a space transfer characteristics indicative of the sound characteristics. In FIG. 2, the voice signals X1, X2 and X3 supplied through the sound signal supply section are processed (control process) at the control section CS. Therefore, the voice output signals are generated and is outputted as voices from the four loudspeakers SP1 through SP4. Twelve space transfer lines are produced between the four loudspeakers SP1 through SP4 and the three control points C1 through C3, respectively, as shown in FIG. 2. The space transfer characteristic representative of the sound characteristic is produced by each of twelve lines. These space transfer characteristics are represented by the following expressions (1) which represents complex transfer characteristic matrix corresponding to the example in FIG. 2 at a desired frequency ω:

$$[G_{ij}(\omega)] = \begin{bmatrix} G_{11}(\omega) & G_{12}(\omega) & G_{13}(\omega) & G_{14}(\omega) \\ G_{21}(\omega) & G_{22}(\omega) & G_{23}(\omega) & G_{24}(\omega) \\ G_{31}(\omega) & G_{32}(\omega) & G_{33}(\omega) & G_{34}(\omega) \end{bmatrix}, \tag{1}$$

where complex input signal matrix is represented by $[X_i(\omega)] = [X_1(\omega), X_2(\omega), X_3(\omega)]^t$, and where $[\bullet]^t$ represents Hermitian conjugate of [•]. When the complex output signal matrix detected at the control point is represented by $[Y_i(\omega)] = [Y_1(\omega), Y_2(\omega), Y_3(\omega)]^t$, the transfer line thereof is expressed by the following expression (2):

$$[G_{ij}(\omega)][H_{ji}(\omega)][X_i(\omega)] = [Y_i(\omega)], \tag{2}$$

where i takes 1 through 3, and j takes 1 through 4.

If an inverse filter $[H_{ji}(\omega)]$ for canceling the transfer characteristic $[G_{ij}(\omega)]$ is designed so as to satisfy the following expression (3), it becomes possible to execute a filtering process employing this inverse filer expression (3).

$$[G_{ij}][H_{ji}][X_i] = [Y_i]$$

$$[G_{ij}(\omega)][H_{ji}(\omega)] = [I_i], \tag{3}$$

where $[I_i]$ is a unit matrix.

By executing the filtering process using this inverse filter expression (3), it becomes possible to correspond the complex input signal matrix $[X_i(\omega)]$ with the complex output signal matrix $[Y_i(\omega)]$ at the control points as expressed by the following expression (4).

$$[X_i(\omega)] = [Y_i(\omega)]. \tag{4}$$

In order to design such an inverse filter $[H_{ji}(\omega)]$, $[H_{ji}(\omega)]$ may be calculated so as to satisfy the expression $[H_{ji}(\omega)] = [G_{ij}(\omega)]^-$, which is based on the expression (3) and where $[\bullet]^-$ is a regular inverse matrix. As a calculation method of $[G_{ij}(\omega)]^-$, for example, it is possible to employ a method shown in a paper "An inverse filter design for transaural-system using least-norm-solution" written by A. Kaminuma, S. Ise and K. Sikano, *Symposium of The Acoustical Society of Japan,* 1-9-13, 1998–09, pp. 495–496.

Further, it is possible to calculate $[G_{ij}(\omega)]^-$ using the following expression (5):

$$[H_{ji}(\omega)] = [G_{ij}(\omega)]^t\{[G_{ij}(\omega)][G_{ij}(\omega)]^t\}[I_i], \tag{5}$$

where the realized inverse filter by the expression (5) is represented by the following expression (6):

$$[H_{ji}(\omega)] = \begin{bmatrix} H_{11}(\omega) & H_{12}(\omega) & H_{13}(\omega) \\ H_{21}(\omega) & H_{22}(\omega) & H_{23}(\omega) \\ H_{31}(\omega) & H_{32}(\omega) & H_{33}(\omega) \\ H_{41}(\omega) & H_{42}(\omega) & H_{43}(\omega) \end{bmatrix}. \tag{6}$$

By executing the filtering process as to the voice input signals on the basis of the calculation expression representative of the inverse filter, the voice output signal is produced, and therefore the voices Y1 through Y3, which satisfy the expression (4), are outputted. Further, in order to facilitate the explanation in FIG. 2, (ω) is omitted in FIG. 2. As discussed above, by deriving the inverse filter shown by the expression (6) as a calculation expression of the filtering process, it will become possible to independently control the voice at each control point on the basis of the space transfer characteristics between the sound sources and the control points, which characteristics are represented as elements in the matrix.

Further, by developing this theory, it will be tried to execute a control for differently controlling voice by each control point. Here, there will be discussed an example in a case that the voice is independently controlled at the respective three control points. In this example, at two points of the three control points, voice is outputted so that the sound pressures corresponding to the voice signals supplied to the respective two controls are maintained. At the remaining one point, the voice is outputted so that the sound pressure corresponding to the voice signal is decreased. If it is possible to execute this control, it becomes possible to clearly output the voice at a control point and to decrease the voice at a control point. A specific process of this control will be discussed. In order that the sound pressure corresponding to the supplied voice signal is maintained at two points of three control points and that the sound pressure corresponding to the supplied voice signal becomes zero at the other one point, the unit matrix $[I_i]$ in the expression (3) is replaced with $[A_i]$ so that the desired filter $[H_{ji}(\omega)]$ is obtained from the following expression (7):

$$[G_{ij}(\omega)][H_{ji}(\omega)] = [A_i], \text{ where } [A_i(\omega)] = \begin{bmatrix} 1 & 0 & 0 \\ 0 & 1 & 0 \\ 0 & 0 & 0 \end{bmatrix}. \tag{7}$$

By this definition, it becomes possible to design the inverse filter $[H_{ji}(\omega)]$ so that the voice corresponding to the supplied voice signal is reproduced at the two control points and that the sound pressure corresponding to the supplied voice signal becomes zero at the other control point. By this designation, the inverse filter $[H_{ji}(\omega)]$ is calculated from the following expression (8):

$$[H_{ji}(\omega)]=[G_{ij}(\omega)]^t\{[G_{ij}(\omega)][G_{ij}(\omega)]^t\}[A_i]. \quad (8)$$

As a result, the inverse filter $[H_{ji}(\omega)]$ is represented by the following expression (9):

$$[H_{ji}(\omega)] = \begin{bmatrix} H_{11}(\omega) & H_{12}(\omega) \\ H_{21}(\omega) & H_{22}(\omega) \\ H_{31}(\omega) & H_{32}(\omega) \\ H_{41}(\omega) & H_{42}(\omega) \end{bmatrix}. \quad (9)$$

By executing the filtering process as to the supplied voice signal on the basis of the calculation expression for realizing this inverse filter, the voice output signals are produced, and therefore the voices corresponding to the supplied voice signals are reproduced at the two control points and that the sound pressure corresponding to the supplied voice signal becomes zero at the one control point, respectively. Accordingly, the outputted voice Y1 has a relationship Y1=X1, the outputted voice Y2 has a relationship Y2=X2, and the outputted voice Y3 has a relationship Y3=0.

Therefore, it is possible to control the sound pressures at the respective control points which are freely selected. It becomes possible to maintain the sound pressure as same as the inputted voice signal at a control point and to output a voice as if the control point is a sound source. Further, since it becomes possible to output a voice whose sound pressure is smaller than that of the inputted voice signal, it becomes possible to decrease the sound at the control point while in a common sound field. That is, it becomes possible to control the sound in the sound field by each control point.

Additionally, since it is possible to know the sound characteristic outputted from the voice output section from the supplied voice signal, it becomes possible to execute the control at each control point with respect to the sound. Therefore, in the event that the voice input section is set as a control point, it is possible to attenuate the voice outputted from the voice output section at the point of the voice input section, so that the voice, which is inputted to the voice input section and outputted from the voice output section, becomes very small. Accordingly, it becomes possible to provide a voice input and output apparatus which is capable of decreasing the influence of the acoustic feedback to the voice input section and to improve a S/N ratio (Signal/Noise ratio) of the voice of a talker.

Referring to FIGS. 3 through 6, there is shown an embodiment of a voice input and output apparatus 100 according to the present invention.

Figure 3:
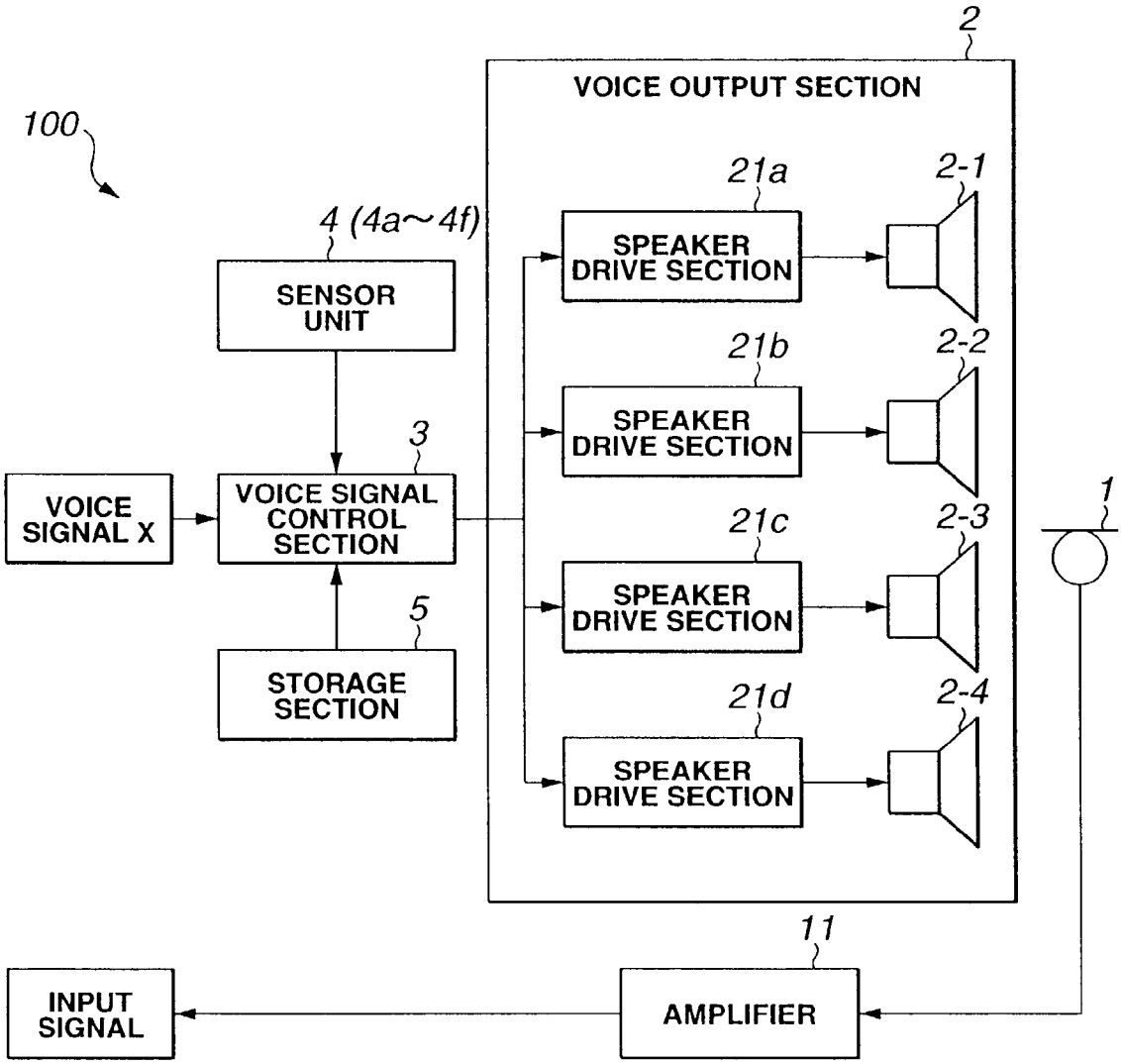
FIG. 3 is a view showing a construction of the voice input and output apparatus according to an embodiment of the present invention.

As shown in FIG. 3, voice input and output apparatus 100 comprises a voice input section 1, a voice output section 2, and a voice signal control section 3. Voice input and output apparatus 100 is installed in a vehicle and is arranged to control a sound field in a passenger compartment of the vehicle. It will be understood that the invention is not limited to this limitation and may be applied to an open or closed space of other object.

Voice input section 1 includes a microphone 1 which receives a voice of a talker. An amplifier 11 amplifies the received voice and outputs it to an external apparatus or an internal apparatus as an input signal. The external or internal apparatus includes a telecommunication apparatus, a voice recognition apparatus, and a voice interactive system.

Voice output section 2 includes loudspeakers 2-1, 2-2, 2-3 and 2-4 which output a voice according to the voice output signals produced by the voice signal control apparatus 3. Four loudspeakers 2-1, 2-2, 2-3 and 2-4 are installed in the passenger compartment of the vehicle and produce a sound field. The four loudspeakers 2-1, 2-2, 2-3 and 2-4 are capable of being independently controlled in volume and tone by each of speaker drive sections 21*a*, 21*b*, 21*c* and 21*d* on the basis of the voice output signals.

Voice signal control section 3 produces voice output signals on the basis of the voice signal X supplied to voice signal control section 3. More specifically, voice signal control section 3 controls the voice output signals according to the voice signal X so as to bring the sound pressures at the control points in the sound field closer to predetermined values, and outputs the voice output signals to voice output section 2. Voice signal control section 3 is coupled to a sensor unit 4 which includes a talker seat-position sensor 4*a* for detecting a seat position of a talker, a talker head-position sensor 4*b* for detecting a head position of the talker, a talker head-direction sensor 4*c* for detecting a direction of the head of the talker, a temperature sensor 4*d*, a moisture sensor 4*e* and a microphone position sensor 4*f*. Further, voice signal control section 3 has a storage section 5 which previously stores information relating to the control. As discussed above, voice signal control section 3 functions as a voice signal receiving section RS and a control section CS in FIG. 1.

The control of voice signal control section 3 is executed on the basis of a space transfer characteristic indicative of a characteristic of a sound between two points in the space. This space transfer characteristic is a characteristics of the sound in the transfer line between the sound source and the observed point, and includes various factors such as an energy condition of the sound generated from the sound source, a transfer medium (air) of the sound field, a directivity of the sound generated from the sound source, a reflection factor of the sound in the sound field, and the other factors relating to the transfer of the sound. This space transfer characteristic is represented by the complex transfer characteristic matrix of the expression (1).

It is preferable that this space transfer characteristic is treated by each sound field and by each control point since the above mentioned factors are complicatedly interacted with each other by each sound field and by each control point.

As to the space transfer characteristic of the passenger compartment, if it is possible to determine various factors such as a space of the passenger compartment, an interior of the passenger compartment, the positions of loudspeakers and the directions of the loudspeakers, it is possible to obtain the space transfer characteristic at a position defined in the passenger compartment by space reference axes, in the sound field produced by the plurality of loudspeakers 2-1, 2-2, 2-3 and 2-4. Further, if the vehicle is equipped with a detecting section for detecting information needed for calculating the space transfer characteristic, it is possible to calculate the space transfer characteristic when voice signal control section 3 outputs the sound output signals.

Figure 4:
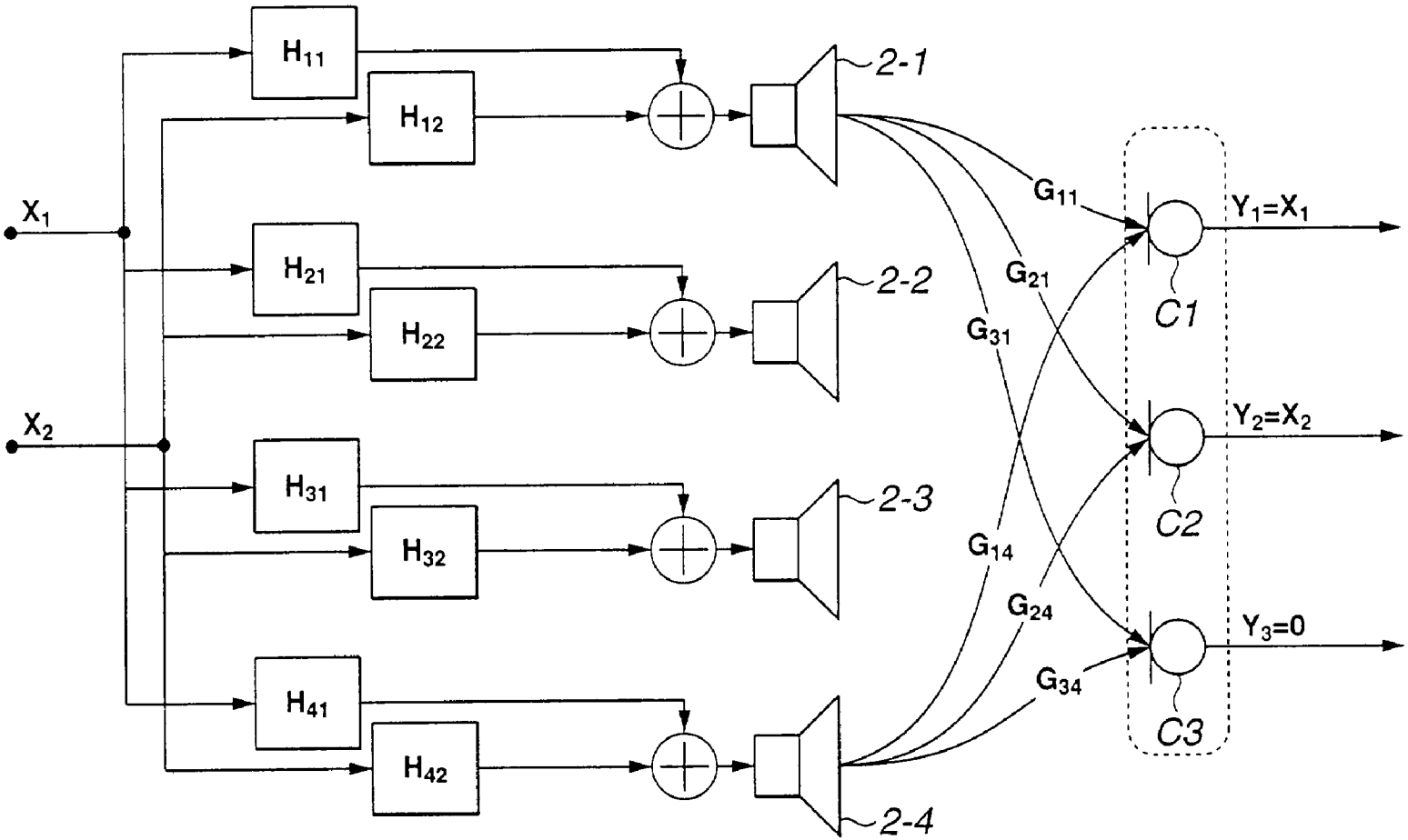
FIG. 4 is a view for explaining a control of the voice input and output apparatus according to an embodiment of the present invention.

FIG. 4 shows each space transfer characteristics $G_{ij}$ produced between each loudspeaker 2-1, 2-2, 2-2, 2-4 and each control point C1, C2, C3. As shown in FIG. 4, the supplied voice signals $X_1$ and $X_2$ are processed by means of the predetermined calculation process and are then outputted to loudspeakers 2-1, 2-2, 2-2 and 2-4. In this embodiment, four loudspeakers 2-1, 2-2, 2-2 and 2-4 are provided in voice input and output apparatus 100 and three control point C1, C2 and C3 are set in the sound field. The sound generated by each loudspeaker 2-1, 2-2, 2-2, 2-4 produces the sound field by being transmitted through transfer medium, and by being transmitted to the three control points C1 through C3. Each loudspeaker 2-1, 2-2, 2-2, 2-4 has three space transfer paths to the respective control points C1 through C3. Accordingly, twelve space transfer paths are produced when four loudspeakers 2-1, 2-2, 2-3 and 2-4 are provided. On the basis of the characteristics of the twelve space transfer paths, the sound pressures at control points C1 through C3 are controlled. This control is executed using the above-discussed principle.

There will be discussed the control of the embodiment according to the present invention while applying to the above-discussed principle.

Space transfer characteristic indicative matrix $[G_{ij}(\omega)]$, sound signal indicative matrix $[X_i(\omega)]$ and voice output signal indicative matrix $[Y_i(\omega)]$ establish the relationship shown by the expression (2). Therefore, by controlling the voice signals $X_i(\omega)$ on the basis of the inverse filter $[H_{ji}(\omega)]$, which cancels the space transfer characteristic indicative matrix $[G_{ij}(\omega)]$ and which is obtained by multiplying the space transfer characteristic indicative matrix $[G_{ij}(\omega)]$ and the unit matrix $[I_i]$, the relationship between the supplied voice signal X and the produced voice Y is controlled as shown by the expression (4). Although the expression (4) defines that the supplied voice signal X is equal to the generated voice Y, the relationship between the supplied voice signal X and the generated voice Y may be freely defined. In order to design such an inverse filter $[H_{ji}(\omega)]$, the calculation expression (6) is obtained by deriving a regular inverse matrix relative to the space transfer characteristic representative of the characteristic of the sound.

It is assumed that it becomes possible to freely control the sound pressures at the respective control points C1 through C3 in this embodiment by executing the control on the basis of this principle. In this embodiment, the three control points are set at positions C1 and C2 of both ears of a listener and a position C3 of microphone 1. More specifically, at the control points C1 and C2, the voice is outputted so that the sound pressure of the outputted voice become equal to that of the supplied voice signals, and at the control point C3 the voice is outputted so that the sound pressure of the outputted voice becomes smaller than that of the supplied voice signal.

In order to independently execute the control by each control point so that at two control points C1 and C2 the sound pressure corresponding to the supplied voice signals are maintained, and at the other control point C3 the inverse filter $[H_{ji}(\omega)]$ of the expression (9) is obtained from the expression (7). That is, the inverse filter $[H_{ji}(\omega)]$ is obtained so that the product of the inverse filter $[H_{ji}(\omega)]$ and the space transfer characteristic indicative matrix $[G_{ij}(\omega)]$ becomes a unit matrix $[A_i]$ whose element at third row and third column takes zero. Thereafter, on the basis of the obtained calculation expression, the voice signals are processed.

On the basis of the produced voice output signal, the energies of the voice to be supplied to the control points C1 and C2, which correspond to the positions of both ears of the listener, are outputted so as to maintain the energy corresponding to the first to be supplied voice signal, and the energy of the voice supplied to the control point C3, which corresponds to the position of the microphone 1, is attenuated. Therefore, it becomes possible to control the outputted voice at each control point so that the outputted voice Y1 shown in FIG. 4 satisfies a relationship Y1=X1, the outputted voice Y2 satisfies a relationship Y2=X2, and the outputted voice Y3 satisfies a relationship Y3=0. Since it is possible to independently control the outputted voice $Y_1$, $Y_2$, $Y_3$ by each control point C1, C2, C3, it becomes possible to combine the control according to the present invention and an acoustics echo-canceller.

Figure 5:
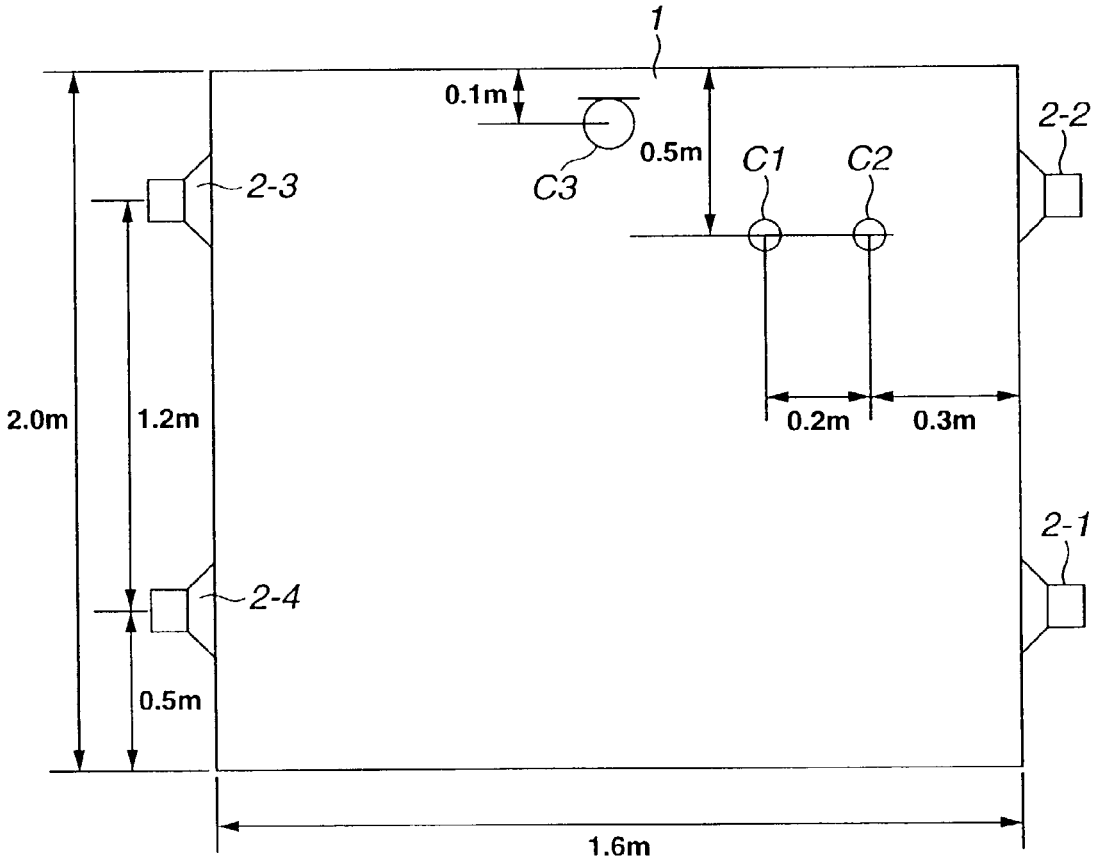
FIG. 5 is a view showing an arrangement of elements of the voice input and output apparatus according to an embodiment of the present invention.

The control method of the voice signal control section 3 in the embodiment according to the present invention has been explained in the above. Subsequently, the control result obtained by the above-discussed control method will be explained with reference to FIG. 5. Since the voice input and output apparatus 100 of the embodiment is arranged to be set in the passenger compartment of the vehicle, the positions of the control points C1 through C3 and the four loudspeakers 2-1 through 2-4 in the passenger compartment are concretely defined as shown in FIG. 5. A compartment space is defined into 1.6 m33 2.0 m space by walls, four loudspeakers 2-1 through 2-4 are located as shown in FIG. 5. The positions of two control points C1 and C2 correspond to the positions of both ears of a listener or a driver. The control point C3 corresponds to the position of microphone 1. Therefore, voice input and output apparatus 100 executes the control so that at the control points C1 and C2 the voice outputted from loudspeakers 2-1 through 2-4 are heard without any modification, and that at the control point C1 the voice outputted from loudspeakers is attenuated.

After the positional relationship of loudspeakers 2-1 through 2-4 and the control points C1 through C3 is determined, the space transfer characteristic on each transfer line between each control point and each sound source is measured and/or calculated. Then, by using the above-discussed method, the inverse filter is derived from the expressions (8) and (9). Further, by using the thus obtained inverse filter, the voice signals are processed, the voice output signals are produced, and the voice is outputted.

The complex sound pressures at the respective control point C1 through C3 in the sound field produced by the outputted voice were calculated on the assumption that a condition of the passenger compartment is as follows:

A height of the passenger compartment is free.

A reflection coefficient of wall is 0.15.

Temperature is 20° C.

As to the frequencies ranging from 200 Hz to 1000 Hz, the calculation was executed by 10 Hz.

After the whole complex sound pressures were summed, the energy of the sound at each control point C1, C2, C3 was obtained, where the energy corresponds to square of an amplitude of sound pressure. The result of this calculation is shown in the following Table 1.

TABLE 1

| CONTROL POINT | C1 | C2 | C3 |
|---|---|---|---|
| ENERGY OF SOUND | 61.69 dB | 59.45 dB | −79.97 dB |

As is clear from Table 1, at the control points C1 and C2, the sound pressure was high, and therefore they are put in the high-energy condition. On the other hand, at the control point C3, the sound pressure was low, and therefore the energy of the sound took a remarkably low value −79.97 dB. This clearly shows that at the control point C3 the sound pressure was decreased to the value which almost cannot be detected.

In this embodiment, the sound pressures at the control points C1 and C2 are differentiated so as to produce a predetermined balance in this compartment. As shown in FIG. 5, the listener is directed toward the side including the microphone 1, the control point C1 corresponds to the left ear of the listener, and the control point C2 corresponds to the right ear of the listener. Referring to Table 1, the sound energy at the left ear is greater than that of the right ear. This result was derived (determined) from the reason that the listener generally detects the direction of the sound source on the basis of the balance between the sound heard by the right ear and the sound heard by the left ear. Accordingly, in this case as shown by Table 1, the listener can sense that the sound is generated from the left and forward direction where the microphone 1 is located. Since the listener feels that the sound is generated from the microphone 1, the listener naturally starts a talking while paying attention toward the microphone 1. By this talking of the listener toward the microphone 1, the voice of the listener has a directivity to the direction of the microphone 1, and therefore a S/N ratio of the voice received by the microphone 1 is improved. That is, by respectively controlling the energy of the sound by each control point, it becomes possible to ensure an advantage as same as that in a case that a virtual sound source is located at a desired position. Accordingly, by arranging as if the virtual sound source is located at the position of the microphone 1, it becomes possible to indicate the position of the microphone 1 to the listener. By this indication, it is expected that the listener starts talking toward the virtual sound source. Therefore, it becomes possible to receive a sound having the directivity to the microphone 1, and voice input and output apparatus 100 can ensure a performance of a high S/N ratio.

Although the above-discussed advantages are ensured by controlling the control points C1 and C2 corresponding to the positions of both ears of the listener, it is possible to simultaneously control the sound pressure (energy of the sound) at the control point C3 corresponding to the position of microphone 1. That is, voice input and output apparatus 100 enables the microphone 1 to receive the sound having a high directivity by producing the virtual sound source at the position of the microphone 1 through the control of the balance between the sound pressures at the control points C1 and C2, and enables the sound pressure at the control point C3 to be decreased. This enables elimination of the acoustic feedback to microphone M. This arrangement ensures advantages different from that by a conventional echo canceller.

Basic control on the basis of the specified space transfer characteristic has been explained. Herein, there will be discussed the processing in the case that the space transfer characteristic is changed.

In this embodiment, it is necessary to accurately determine the space transfer characteristic in order to improve the accuracy of the control since voice input and output apparatus 100 is arrange to executed the control on the basis of the space transfer characteristics. Accordingly, in this embodiment, voice input and output apparatus 100 comprises sensor unit 4 including various sensors 4*a* through 4*f* for detecting the change of the space transfer characteristic and storage section 5 for storing various processes and information employed for quickly executing the processing in response to the change of the space transfer characteristics.

Circumstantial factors affecting the space transfer characteristic include the position and direction of microphone 1, the positions and directions of loudspeakers 2-1 through 2-4, the position and direction of the listener, the position of a seat, the temperature and the humidity. Storage section 5 has previously stored the physical quantity indicative of the circumstantial factors and the calculation expression employed in the filtering processing of the voice signal in the form of filtering process data. The filtering process data may directly comprise the filtering process or may comprise the space transfer characteristic and a process for deriving the calculation expression from the space transfer characteristic. In the present embodiment, storage section 5 has previously stored the filtering process in the form of the filter processing table from the viewpoint of improving the processing speed. Further, the storage section is constructed by cache memory, main memory, disc memory and combination thereof.

When the change of the space transfer characteristic is detected from the output of the sensor unit 4, voice signal control section 3 retrieves the filtering process table stored in storage section 5, executes the filtering process according to the newly retrieved circumstantial factors of the supplied voice signals, and produces the voice output signals.

Figure 6:
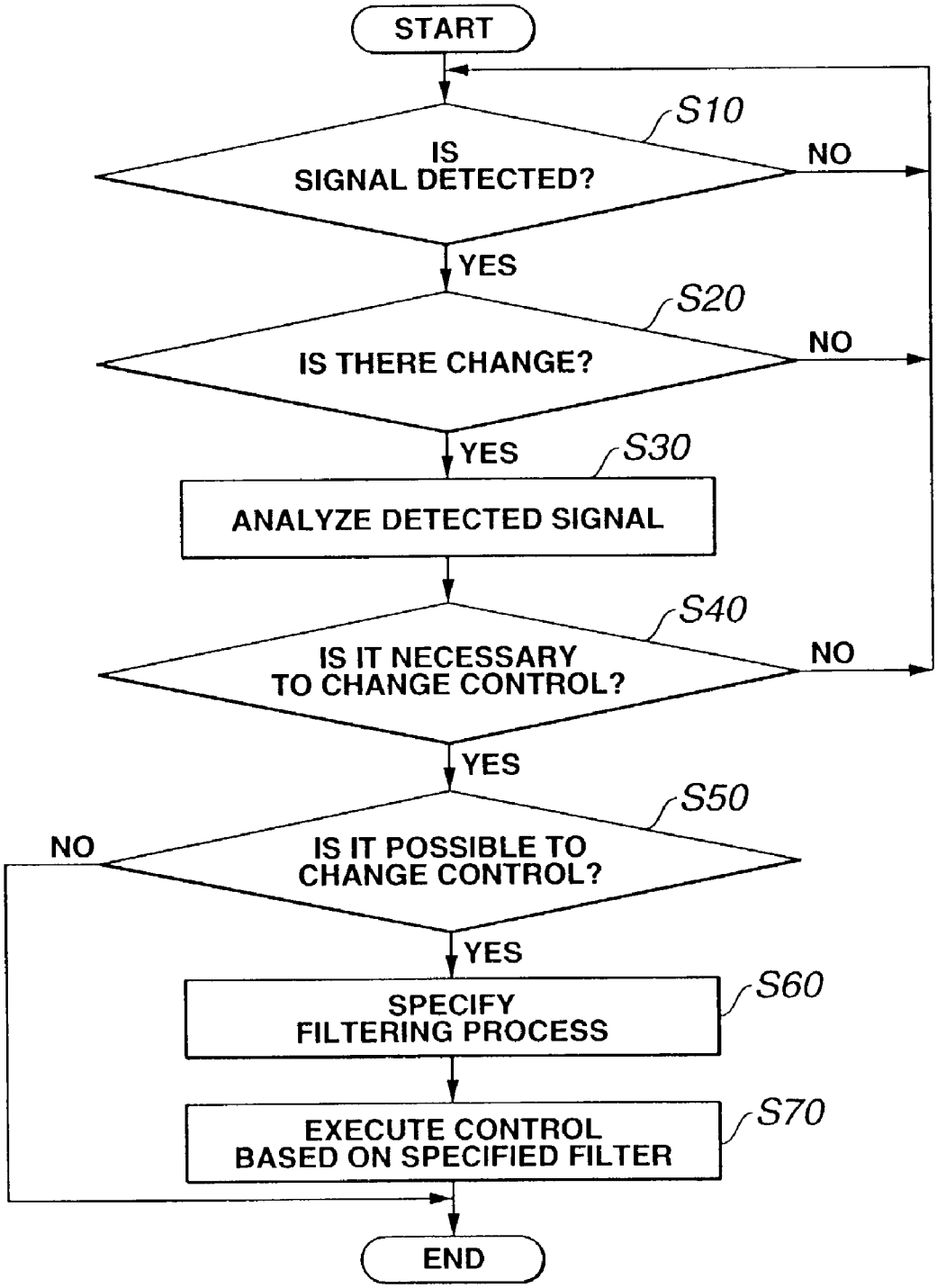
FIG. 6 is a flowchart showing a control procedure in a case that a circumstantial condition of the embodiment is changed.

With reference to a flowchart of FIG. 6, there will be discussed the control of voice signal control section 3 in the event that the sensor unit 4 detects the change of the circumferential factors. This routine shown in FIG. 6 is started in response to the turning on of voice input and output apparatus 100. Further, this routine shown in FIG. 6 is executed at predetermined time intervals when voice input and output apparatus 100 is set at on state.

At step S10, control section 3 of voice input and output apparatus 100 determines whether or not sensor unit 4 detects signals indicative of the circumstantial factors. When the determination at step S10 is negative, the routine repeats step S10. When the determination at step S10 is affirmative, the routine proceeds to step S20.

At step S20, control section 3 determines whether or not at least one of the circumstantial factors is changed, on the basis of the detected signals. When the determination at step S20 is affirmative, the routine proceeds to step S30. When the determination at step S20 is negative, the routine returns to step S10.

At step S30, control section 3 analyzes the detected signals. More specifically, control section 3 compares the newly detected signals with initially set data or previously detected data.

At step S40, control section 3 determines whether or not it is necessary to change the control condition (filtering process) on the basis of the analyses at step S30. More specifically, control section 3 determines whether a difference between the detected signal at step S10 and the stored signal is smaller than a threshold. When the difference is smaller than the threshold, control section 3 determines that it is not necessary to change the control condition, that is, to change factors of the filter. When the difference becomes greater than or equal to the threshold, that is, when the circumstantial factors are largely varied, the routine proceeds from step S40 to step S50. That is, when the determination at step S40 is affirmative, the routine proceeds to step S50. When the determination at step S40 is negative, the routine returns to step S10.

At step S50, control section 3 determines whether or not it is possible to change the control. More specifically, when the listener approaches microphone 1, or when one of control points excessively approaches the listener, or when a door of the vehicle is open, it is inappropriate to change the control content. Accordingly, when voice input and output apparatus 100 is put in one of the above inappropriate situations or other inappropriate situations, control section 3 determines that it is inappropriate to change the control content and makes the negative determination at step S50. When the negative determination is made at step S50, the routine jumps to an end block to terminate the present routine. On the other hand, when control section 3 determines that it is possible to change the control, that is, when the affirmative determination is made at step S50, the routine proceeds to step S60.

At step S60, control section 3 specifies the filtering process adapted to the changed circumferential factors by retrieving the filtering process table. Then, the routine proceeds to step S70.

At step S70, control section 3 executes the control based on the specified filter.

With the thus arranged control executed by voice signal control section 3, even when the space transfer characteristic are changed by the generation of a change in the circumstantial condition, voice input and output apparatus 100 can execute the filtering process adapted to the actual circumstantial condition and the space transfer characteristics based of the actual circumstantial condition.

As described above, voice input and output apparatus 100 according to the present invention is capable of independently controlling the sound pressure at the plural control points. Accordingly, by largely attenuating the sound pressure at the position near microphone M so as to suppress the affect of returning sound and by directly outputting the sound pressure at the positions corresponding to both ears of a listener, it becomes possible that the listener can hear a voice outputted from apparatus 100 without having a strange feeling and without generating a howling by setting the sound pressure at the position near microphone 1. Further, by controlling the sound pressures at the respective control points, it is possible to produce a virtual sound source at a desired direction. This enables the listener to talk toward the microphone M by setting it as a virtual sound source so as to improve a S/N ratio of the voice detected by microphone M. Accordingly, it becomes possible to provide a voice input and output apparatus which prevents the generation of howling, supplies a clear voice to the listener and accurately performs in telecommunication, voice recognition and voice synthesis.

This application is based on Japanese Patent Application No. 2002–8909 filed on Jan. 17, 2002 in Japan. The entire contents of this Japanese Patent Application are incorporated herein by reference.

Although the invention has been described above by reference to certain embodiments of the invention, the invention is not limited to the embodiments described above. Modifications and variations of the embodiments described above will occur to those skilled in the art, in light of the above teaching. The scope of the invention is defined with reference to the following claims.

What is claimed is:

1. A voice input and output apparatus, comprising:

a voice output section producing a sound field by outputting a sound on the basis of a voice output signal; and a voice signal control section generating the voice output signal according to a voice input signal so that a balance among sound pressures at a plurality of control points in the sound field takes a predetermined balance, wherein the voice signal control section derives a calculation expression of a filtering process for setting the sound pressures of the control points at predetermined values on the basis of sound characteristics between the voice output section and the control points, and the voice signal control section produces the voice output signal by executing the filtering process of the voice input signal.

2. The voice input and output apparatus as claimed in claim 1, wherein the voice signal control section determines a position of the voice input section as a control point and produces the voice output signal so that the sound pressure at the control point is attenuated as compared with the sound pressure corresponding to the voice signal.

3. The voice input and output apparatus as claimed in claim 1, wherein the voice signal control section sets positions of both ears of a listener at the control points and controls the sound pressures at the control points so that the listener feels that a virtual sound source is disposed at a position of a voice input section.

4. The voice input and output apparatus as claimed in claim 1, wherein the voice signal control section comprises a storage section that stores a filtering process table which shows a relationship between a calculation expression of the filtering process and a circumstantial condition relating to a characteristic of the sound, and a condition detecting section that detects the circumstantial condition, wherein when the condition detecting section detects a change of the circumstantial condition, the voice signal control section produces the voice output signal by executing the filtering process of the voice signal on the basis of the newly detected circumstantial condition and with reference to the filtering process table.

5. The voice input and output apparatus as claimed in claim 1, wherein the voice signal control section determines positions of both ears of a listener as the control points and produces the voice output signal so that the sound pressures at the control points are substantially equal to a sound pressure corresponding to the voice input signal.

6. The voice input and output apparatus as claimed in claim 5, wherein the voice signal control section is coupled to a detecting section for detecting positions of both ears of the listener and sets the detected positions of both ears at the control points.

7. The voice input and output apparatus as claimed in claim 1, further comprising a voice input section which receives a voice of a listener who hears the sound at the control point as if the sound is outputted from the voice input section.

8. The voice input and output apparatus as claimed in claim 7, wherein the voice output section includes four loudspeakers and the voice input section includes a microphone which is disposed at one of the control points which the listener feels as a position of a sound source the sound.

9. A method of outputting a sound with directionality, comprising:

receiving a voice input signal;

generating a voice output signal according to the voice input signal so that a balance among sound pressures at a plurality of control points in a sound field takes a predetermined balance; and producing the sound field with a voice output section by outputting the sound on the basis of the voice output signal; and deriving a calculation expression of a filtering process for setting the sound pressures of the control points at predetermined values on the basis of the sound characteristics between the voice output section and the control points, and producing the voice output signal by executing the filtering process of the voice input signal.

10. A voice input and output apparatus provided in a passenger compartment of a vehicle, comprising:

a voice output section producing a sound field by outputting a sound on the basis of a voice output signal;

a condition detecting section detecting a circumstantial condition relating to a characteristic of the sound;

a storage section storing a filtering process table which shows a relationship between a calculation expression of the filtering process of a circumstantial condition relating to a characteristic of the sound; and a voice signal control section coupled to the voice output section, the condition detecting section and the storage section, the voice signal control section receiving a voice input signal, the voice signal control section being arranged to determine according to a change of the circumstantial condition whether the calculation expression is changed, to determine the calculation expression from the relationship and the circumstantial condition, and to produce the voice output signal by executing the filtering process of the voice input signal using the calculation expression.

11. A voice input and output apparatus, comprising:

voice outputting means for producing a sound field by outputting a sound on the basis of a voice output signal; and voice signal controlling means for generating the voice output signal according to a voice input signal so that a balance among sound pressures at a plurality of control points in the sound field takes a predetermined balance; wherein the voice signal controlling means derives a calculation expression of a filtering process for setting pressures of the control points at predetermined values on the basis of sound characteristics between the voice outputting means and the control points, and the voice signal controlling means produces the voice output signal by executing the filtering process of the voice input signal.

* * * * *